US008297466B2

(12) United States Patent
Daley et al.

(10) Patent No.: US 8,297,466 B2
(45) Date of Patent: Oct. 30, 2012

(54) SEWAGE TANKS AND GRINDER PUMP SYSTEMS

(75) Inventors: Paul J. Daley, Waterford, NY (US); Clark A. Henry, Scotia, NY (US); Adrian Massey, Narre Warren (AU)

(73) Assignee: Environment One Corporation, Niskayuna, NY (US)

( * ) Notice: Subject to any disclaimer, the term of this patent is extended or adjusted under 35 U.S.C. 154(b) by 0 days.

(21) Appl. No.: 12/621,917

(22) Filed: Nov. 19, 2009

(65) Prior Publication Data

US 2010/0213199 A1 Aug. 26, 2010

Related U.S. Application Data

(63) Continuation of application No. 11/337,363, filed on Jan. 23, 2006, now Pat. No. 7,624,892, which is a continuation-in-part of application No. PCT/US2005/027280, filed on Aug. 1, 2005.

(60) Provisional application No. 60/598,231, filed on Aug. 2, 2004.

(51) Int. Cl.
*B65D 88/76* (2006.01)
*B65D 21/02* (2006.01)

(52) U.S. Cl. ..... 220/567.1; 206/511

(58) Field of Classification Search ..... 220/567.1, 220/565, 4.12, 505, 634, 623, 610, 660, 503, 220/501, 676, 675, 669, 636, 635, 628, 913, 220/DIG. 27, 745, 582, 581, 367.1, 203.02, 220/203.01, 202; 210/533, 532.1, 173; D23/205, D23/203, 202; D9/691, 690, 682; 206/511, 206/509, 507, 505

See application file for complete search history.

(56) References Cited

U.S. PATENT DOCUMENTS

| | | | | |
|---|---|---|---|---|
| 1,933,012 | A | 10/1933 | Hahn | 220/565 |
| 2,378,756 | A | 6/1945 | Durdin | 210/298 |
| D154,966 | S | 8/1949 | Walsh | D23/205 |
| 2,872,079 | A * | 2/1959 | Moore | 222/143 |

(Continued)

FOREIGN PATENT DOCUMENTS

| | | |
|---|---|---|
| DE | 4445276 | 6/1996 |

(Continued)

OTHER PUBLICATIONS

E/One Sewers™ GP2012 Brochure, 10 pp., 2002.

(Continued)

*Primary Examiner* — Mickey Yu
*Assistant Examiner* — Robert J Hicks
(74) *Attorney, Agent, or Firm* — Heslin Rothenberg Farley & Mesiti P.C.

(57) ABSTRACT

A sewage tank for use with a pump such as a grinder pump to convey sewage. The sewage tank includes a container having an upper portion and a lower tapering portion defining a chamber for containing the pump. The lower tapering portion has a reduced size compared to the upper portion. The upper portion and the lower portion may include a plurality of intersecting vertical ribs and horizontal ribs defining a plurality of recessed pockets. The lower portion of the sewage tank may also include an outwardly-extending flange sufficiently sized so that soil may be backfilled around the bottom of the tank to prevent the tank from floating upward out of the ground due to its buoyancy under high ground water conditions. The sewage tank may also include a stepped flange.

30 Claims, 13 Drawing Sheets

U.S. PATENT DOCUMENTS

| | | | | | |
|---|---|---|---|---|---|
| D190,948 | S | | 7/1961 | Paulson | D23/202 |
| 3,451,553 | A | | 6/1969 | Davis | |
| 3,515,302 | A | | 6/1970 | Curran | |
| D233,233 | S | | 10/1974 | Murray et al. | D23/203 |
| D239,506 | S | | 4/1976 | Myers | D23/202 |
| 3,964,636 | A | | 6/1976 | Rehrig | 220/495.06 |
| 3,972,450 | A | | 8/1976 | Walters | 222/91 |
| 4,014,475 | A | * | 3/1977 | Grace et al. | 241/36 |
| D244,092 | S | | 4/1977 | Mowatt-Larssen et al. | D23/205 |
| D249,050 | S | | 8/1978 | Friesen et al. | D23/205 |
| 4,359,167 | A | | 11/1982 | Fouss et al. | 220/675 |
| 4,717,040 | A | | 1/1988 | Stanton | 52/20 |
| 4,718,208 | A | | 1/1988 | Fons | D23/192 |
| 4,909,393 | A | | 3/1990 | Palisin, Jr. | 206/519 |
| 4,961,670 | A | | 10/1990 | McKenzie et al. | 405/53 |
| D357,530 | S | | 4/1995 | Grenier et al. | D23/203 |
| 5,439,180 | A | | 8/1995 | Baughman et al. | 241/36 |
| 5,494,183 | A | | 2/1996 | Sharp | 202/62.19 |
| 5,553,794 | A | * | 9/1996 | Oliver et al. | 241/36 |
| 5,562,254 | A | | 10/1996 | Sleasman et al. | 241/46.01 |
| 5,590,803 | A | | 1/1997 | Kaempen | 220/560.03 |
| 5,597,948 | A | | 1/1997 | Sharp | 73/49.2 |
| 5,752,315 | A | | 5/1998 | Sleasman et al. | 29/888 |
| D397,763 | S | | 9/1998 | Sabo | D23/203 |
| 5,806,702 | A | | 9/1998 | Sabo | 220/4.12 |
| 5,816,510 | A | | 10/1998 | Earle, III et al. | 241/46.01 |
| 6,059,208 | A | | 5/2000 | Struthers | 241/46.01 |
| 6,227,396 | B1 | | 5/2001 | Small | 220/4.12 |
| 6,280,614 | B1 | | 8/2001 | Berg et al. | 210/170 |
| 6,305,410 | B1 | | 10/2001 | Cook et al. | 137/363 |
| 6,554,696 | B2 | | 4/2003 | Kowalski et al. | 454/155 |
| D492,000 | S | | 6/2004 | Festa et al. | D23/203 |
| 6,763,950 | B2 | | 7/2004 | Graves | 210/513 |
| D529,573 | S | | 10/2006 | Daley | D23/203 |
| D552,708 | S | | 10/2007 | Daley et al. | D23/203 |
| D556,293 | S | | 11/2007 | Daley et al. | D23/203 |
| D574,921 | S | | 8/2008 | Massey | D23/206 |
| 2005/0178721 | A1 | | 8/2005 | Lombardi, II | 210/532.2 |
| 2006/0260993 | A1 | | 11/2006 | Daley et al. | 210/173 |

FOREIGN PATENT DOCUMENTS

| | | |
|---|---|---|
| DE | 199 61 414 | 7/2001 |
| FR | 2790495 | 9/2000 |
| JP | 52061818 | 5/1977 |

OTHER PUBLICATIONS

E/One Sewers™ GP2014 Brochure, 8 pp., Mar. 2003.

Zabel® Environmental Technology Catalog, 2003, "ZABEL in a Can," pp. 56-57.

Zabel® Environmental Technology Catalog, 2003, "Step Systems Zeus Step Packages ZS-300," p. 85.

Zabel® Environmental Technology Catalog, 2003, "Step Systems Pressure Distribution (Distribution Valve Assembly) PDS-DV-6-6-6-AP," p. 121.

Zabel® Environmental Technology Catalog, 2003, "Tankage System Polyethylene Basins (20" Diameter Basin)," p. 142.

Zabel® Environmental Technology Catalog, 2003, "Effluent Filters Filter Packages A1800-4×22-VT-B35- FP," p. 172.

Mono Pumps Ltd, Next Generation in Pressure Sewer Equipment Brochure, available at Water Services Association of Australia (WSAA) Pressure Users Group Workshop in Melbourne, Australia, 1-page, Nov. 20-21, 2006.

Mono Pumps Ltd, Dimensional Drawing, PSS-ECO160-9900, available on-line Mar. 5, 2009, at http://www.monopumps.com.au/sites/monopumps.com.au/files/drawings/documents/ ECO1-60%20900LT%20GA_0.pdf, 1-page, dated Feb. 14, 2007.

Mono Pumps Ltd, Dimensional Drawing, PSS-ECO160A-9900, available on-line Mar. 5, 2009, at http://www.monopumps.com.au/sites/monopumps.com.au/files/drawings/documents/ EC01-60A_DryWell.pdf, 1-page, dated Sep. 2, 2008.

Mono Pumps Ltd, Dimensional Drawing, PSS-EC0160B-9900, available on-line Mar. 5, 2009, at http://www.monopumps.com.au/sites/monopumps.com.au/files/drawings/documents/ ECO1-60B_2200LT.pdf, 1-page, dated Sep. 10, 2008.

Mono Pumps Ltd, Dimensional Drawing, PSS-ECO160C-9900, available on-line Mar. 5, 2009, at http://www.monopumps.com.au/sites/monopumps.com.au/files/drawings/documents/PSS_ECO160C.pdf, 1-page, dated Sep. 11, 2008.

Mono Pumps Ltd, Dimensional Drawing, PSS-ECO160D-9900, available on-line Mar. 5, 2009, at http://www.monopumps.com.au/sites/monopumps.com.au/files/drawings/documents/ ECO1-600D_900LTD_DEEP_INLET_GA.pdf, 1-page, dated Mar. 2, 2007.

Mono Pumps Ltd, Dimensional Drawing, PSS-ECO260-9902, available on-line Mar. 5, 2009, at http://www.monopumps.com.au/sites/monopumps.com.au/files/drawings/documents/ECO2-60_900LT.pdf, 1-page, dated Sep. 2, 2008.

Mono Pumps Ltd, Dimensional Drawing, PSS-ECO260A-9900, available on-line Mar. 5, 2009, at http://www.monopumps.com.au/sites/monopumps.com.au/files/drawings/documents/ECO2-60A_DRY_WELL_GA.pdf, 1-page, dated May 31, 2007.

Mono Pumps Ltd, Dimensional Drawing, PSS-ECO260B-9800, available on-line Mar. 5, 2009, at http://www.monopumps.com.au/sites/monopumps.com.au/files/drawings/documents/ECO2-60B%202200LT%20General%20Arrangement.pdf, 1-page, dated Dec. 7, 2007.

Mono Pumps Ltd, Dimensional Drawing, PSS-ECO260C-9900, available on-line Mar. 5, 2009, at http://www.monopumps.com.au/sites/monopumps.com.au/files/drawings/documents/PSS_ECO260C.pdf, 1- page, dated Sep. 11, 2008.

Zabel® Environmental Technology Catalog, 2003, "Advance Treatment Accessories (Recirculation Devices) ATS-GRD-100/80/20," p. 73.

* cited by examiner

SEWAGE TANKS AND GRINDER PUMP SYSTEMS

CROSS-REFERENCE TO RELATED APPLICATION

This application is a continuation of U.S. patent application Ser. No. 11/337,363, filed Jan. 23, 2006 and entitled "Sewage Tanks And Grinder Pump Systems", which issued on Dec. 1, 2009, as U.S. Pat. No. 7,624,892, which application is a continuation-in-part of PCT patent applications PCT/US2005/027280, filed Aug. 1, 2005, entitled "Sewage Tanks and Grinder Pump Systems," which claims the benefit of U.S. Provisional Application Ser. No. 60/598,231, filed Aug. 2, 2004, the entire subject matter of these applications is incorporated herein by reference.

FIELD OF THE INVENTION

This invention relates generally to sewage tanks, and more particularly, to sewage tanks for use with pumps such as grinder pumps.

BACKGROUND OF THE INVENTION

Grinder pumps are often used in low-pressure sewage systems for pumping sewage. A grinder pump includes a grinder mechanism for cutting or grinding solids or semisolid matter in the sewage being pumped. Grinding solids and/or semisolid matter in the sewage allows the resulting particulate effluent to be transferred using a pump through a small diameter pipe without clogging.

Typically, conventional sewage tanks are installed by digging a hole, placing the tank in the ground, and then pouring concrete around the bottom of the tank. The concrete provides proper ballast to prevent the tank from floating upwardly and popping out of the ground due to its buoyancy under high ground water conditions.

One particular attempt at a sewage tank by Environment One Corporation is the 2000 Series, GP 2012 grinder pump system which includes a generally cylindrical wet well sewage tank portion with a curved top edge and curved bottom edge. A plurality of hollow vertical ribs runs along the length of the tank. A single hollow horizontal rib runs along the middle of the cylindrical portion of the tank. A grinder pump is supported in the tank.

Another attempt at a sewage tank by Environment One Corporation is the 2000 Series, GP 2014 grinder pump system having a wet well sewage tank portion configured with an upper half and a lower half. The lower half is generally cylindrical with a curved bottom edge. A plurality of hollow vertical ribs runs along the length of the lower half. A single hollow horizontal rib runs along the middle cylindrical portion of the lower half. The upper half is generally cylindrical with a curved top edge. A plurality of hollow vertical ribs runs along the length of the upper half. A single hollow horizontal rib runs along the middle cylindrical portion of the upper half. To form the GP 2012 sewage tank, a two-piece mold is used, and to form the GP 2014 sewage tank, a six-piece mold is used.

There is a need for further sewage tanks and pump systems.

SUMMARY OF THE INVENTION

The present invention provides, in a first aspect, a sewage tank for use with a pump to convey sewage. The sewage tank includes a container having an upper portion and a lower tapering portion defining a chamber for containing the pump. The lower tapering portion has a reduced size compared to the upper portion. The upper portion includes a plurality of intersecting vertical ribs and horizontal ribs defining a plurality of recessed pockets, and the lower tapering portion includes a plurality of intersecting vertical ribs and horizontal ribs defining a plurality of recessed pockets.

The present invention provides, in a second aspect, a sewage tank for use with a pump to convey sewage. The sewage tank includes a container having an upper portion and a lower portion defining a chamber for containing the pump. The lower tapering portion has a reduced size compared to the upper portion. The lower portion of the container has an outwardly-extending member. The lower tapering portion of the container and the outwardly-extending member are configured to allow backfilling of the sewage tank so that the backfill provides sufficient ballast under high ground water conditions.

The present invention provides, in a third aspect, a sewage tank for use with a pump to convey sewage. The sewage tank includes a container for containing the pump and an upper portion having an inwardly-extending portion for providing an opening for a vent.

The present invention provides, in a fourth aspect, a pump system which includes the above-described sewage tank and a pump such as a grinder pump disposable in the sewage tank.

The present invention provides, in a fifth aspect. a method for installing a sewage tank. The method includes providing a sewage tank having a lower tapering portion and an outwardly-extending member, and backfilling around the lower tapering portion of the sewage tank.

BRIEF DESCRIPTION OF THE DRAWINGS

The subject matter which is regarded as the invention is particularly pointed out and distinctly claimed in the concluding portion of the specification. The invention, however, may best be understood by reference to the following detailed description of various embodiments and accompanying drawings in which:

DETAILED DESCRIPTION OF THE INVENTION

Figure 1:
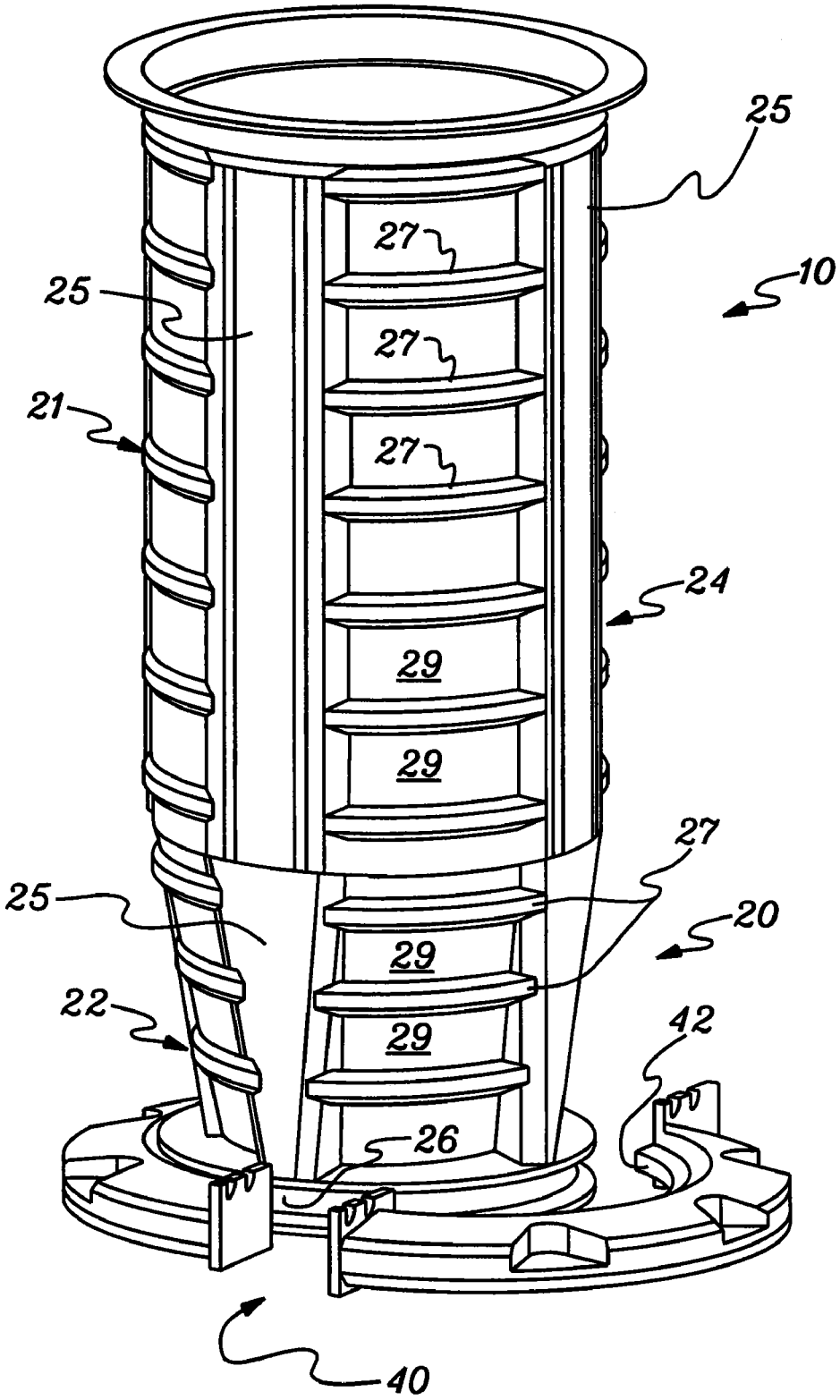
FIG. 1 is a perspective view of one embodiment of a grinder pump system in accordance with the present invention.
Figure 2:
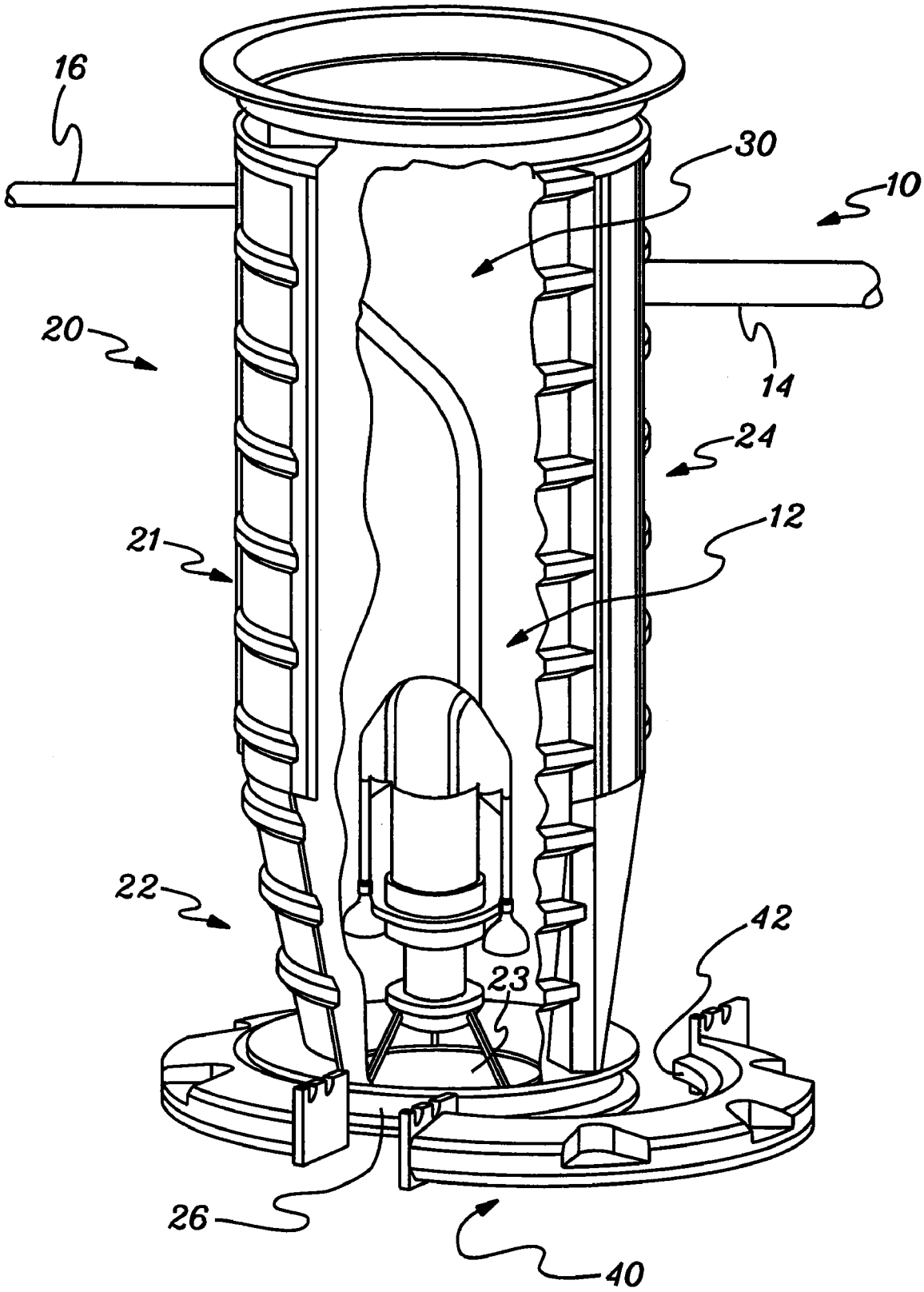
FIG. 2 is a perspective view, partially cutaway, of the grinder pump system of FIG. 1.

FIGS. 1 and 2 illustrate one embodiment of a low-pressure grinder pump wastewater disposal system 10 in accordance with the present invention for collecting, grinding, and pumping wastewater. System 10 generally includes a sewage tank 20 and a grinder pump 12 (FIG. 2).

System 10 is readily installable in the ground by connecting the system to a wastewater feed pipe 14 (FIG. 2), a wastewater discharge pipe 16 (FIG. 2), and an electrical power supply (not shown). The system may also be connected to or include a vent (not shown). The exemplary wastewater disposal system provides a convenient, self-contained unit. In addition, the exemplary system is readily accessible and serviceable by a technician or a repairperson.

Sewage tank 20 includes a container 21 having a lower portion 22 and an upper portion 24 which together define a chamber 30 (FIG. 2) therein for receiving wastewater, for example, from a building. In one aspect, the upper portion may have a generally constant cross-section, e.g., generally cylindrical, and the lower portion has a tapering cross-section to reduce the volume of retained sewage. The upper portion and the lower portion may include a plurality of intersecting vertical ribs 25 and horizontal ribs 27 defining a plurality of recessed pockets 29. The vertical ribs may extend along the length of the tank, and the horizontal ribs may extend around the tank. The plurality of vertical ribs and horizontal ribs may be hollow and open to the inside of the container. The plurality of vertical ribs, the plurality of horizontal ribs, and the plurality of recessed pockets are configured to provide an opening for installation of at least one of an inlet, an outlet, and a vent. The plurality of ribs aid in strengthening the upper and lower portions of the tank. The ribs and pockets may be sized to provide an inlet, an outlet, or a vent at continuous selectable vertical elevations along the upper portion of the container. As best shown in FIG. 2, the bottom of the sewage tank may include a concave bottom 23.

Another aspect of the present invention is the elimination of conventional concrete ballast thereby eliminating the need and labor associated with pouring concrete around the bottom of the sewage tank in the ground to prevent the sewage tank from floating upward due to its buoyancy under high ground water conditions.

As shown in FIGS. 1 and 2, sewage tank 20 may include a two-piece ring or flange 40 that may be connectable to the bottom of the tank. Flange 40 increases the footprint of the sewage tank (e.g., extends laterally outward from the sidewall) so that the soil above the flange acts as a ballast preventing the sewage tank from floating upwardly and popping out of the ground during high ground water conditions. The flanges may include bolt-on flanges, snap-on flanges, or other suitably connectable flanges. The flange may be provided with an inwardly-extending tongue 42 that is received in a groove 26 extending around the bottom of the sewage tank. In addition, the sewage tank without the flange may allow conventional installation with concrete. For example, the concrete can grab on or secure to groove 26 on the bottom of the sewage tank.

The size of the flange may be determined based on the displaced volume of the soil and/or the volume of the sewage tank in order to provide suitable ballast under high ground water conditions. In one embodiment, a sewage tank about 95 inches high (with access way extension) and about 29 inches wide may include a flange having an outer circular edge with a diameter of about 40 inches.

The bottom portion of the sewage tank may be tapered so that when the pump shuts off the sewage remaining in the bottom of the sewage tank is reduced compared to a tank having a constant cross-section from top to bottom. Desirably, the taper is, e.g. about 10 degrees, thereby making it relatively easy to backfill and compact the backfill during installation. The diameter of the flange may be greater than the diameter of the cylindrical upper portion. Desirably, the radial distance of the flange under the upper portion is equal to the radial distance of the flange that extends beyond the upper portion.

Figure 3:
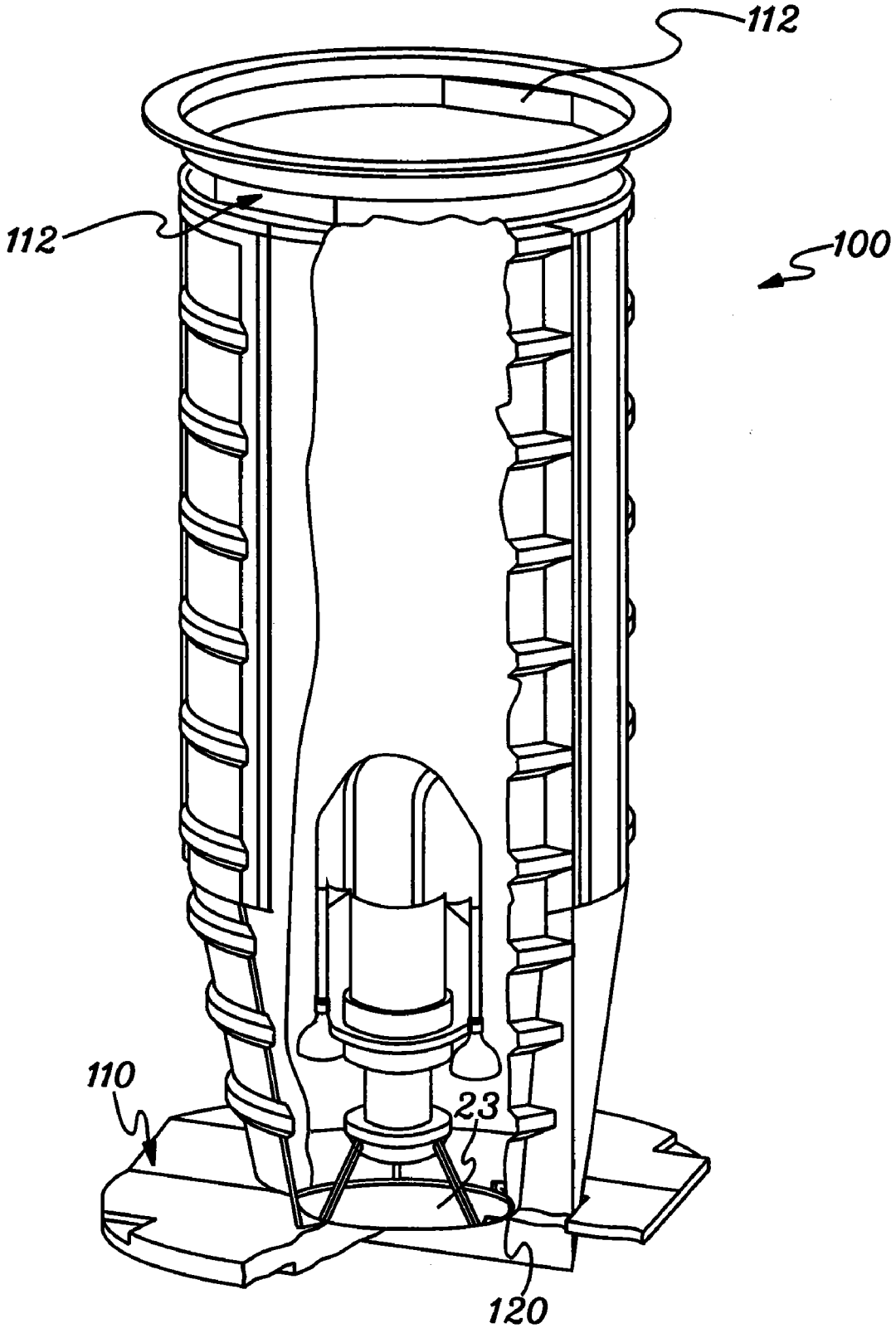
FIG. 3 is a perspective view, partially cutaway, of another embodiment of a grinder pump system in accordance with the present invention.
Figure 4:
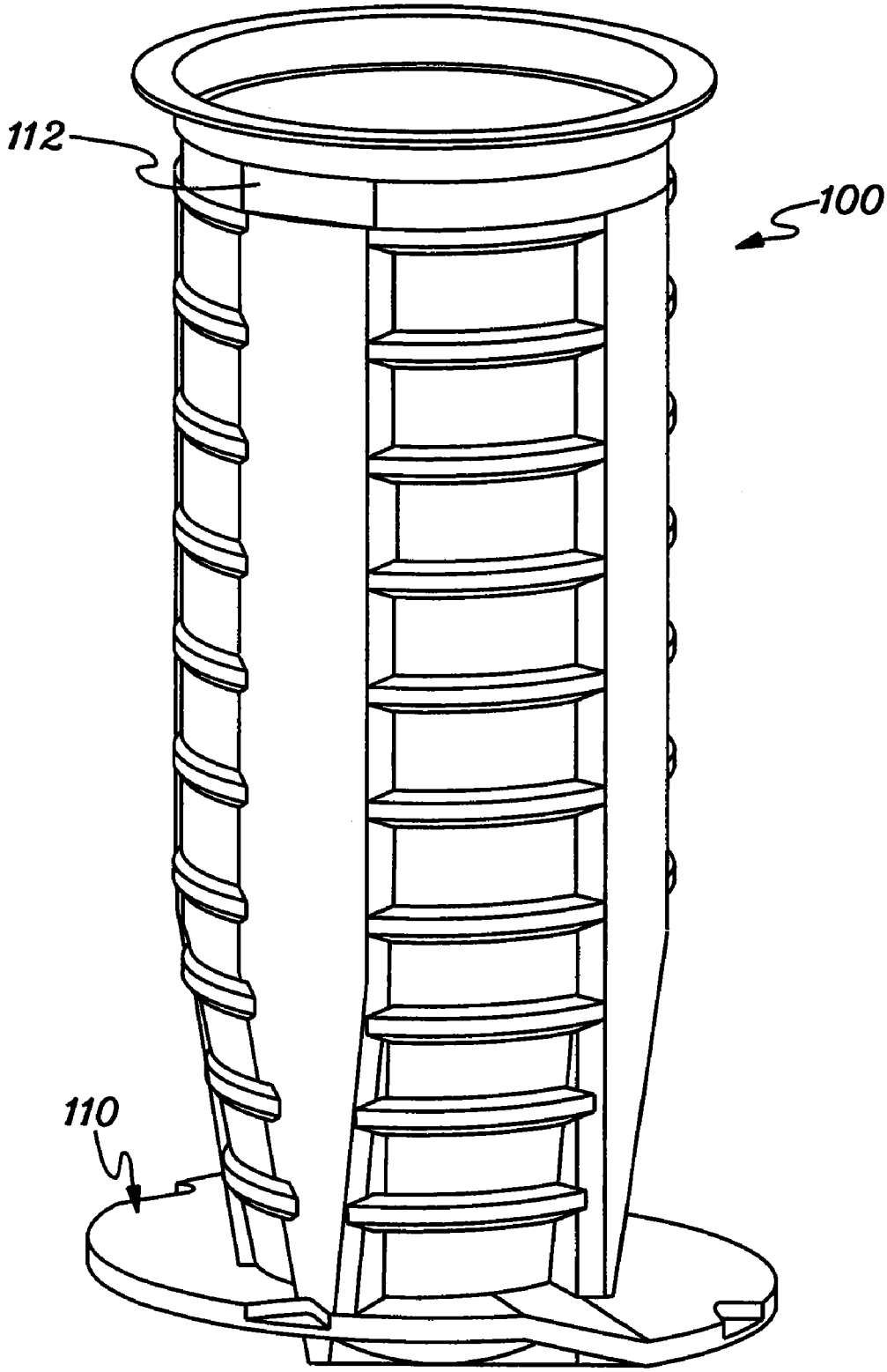
FIG. 4 is a perspective view of the sewage tank of FIG. 3.
Figure 5:
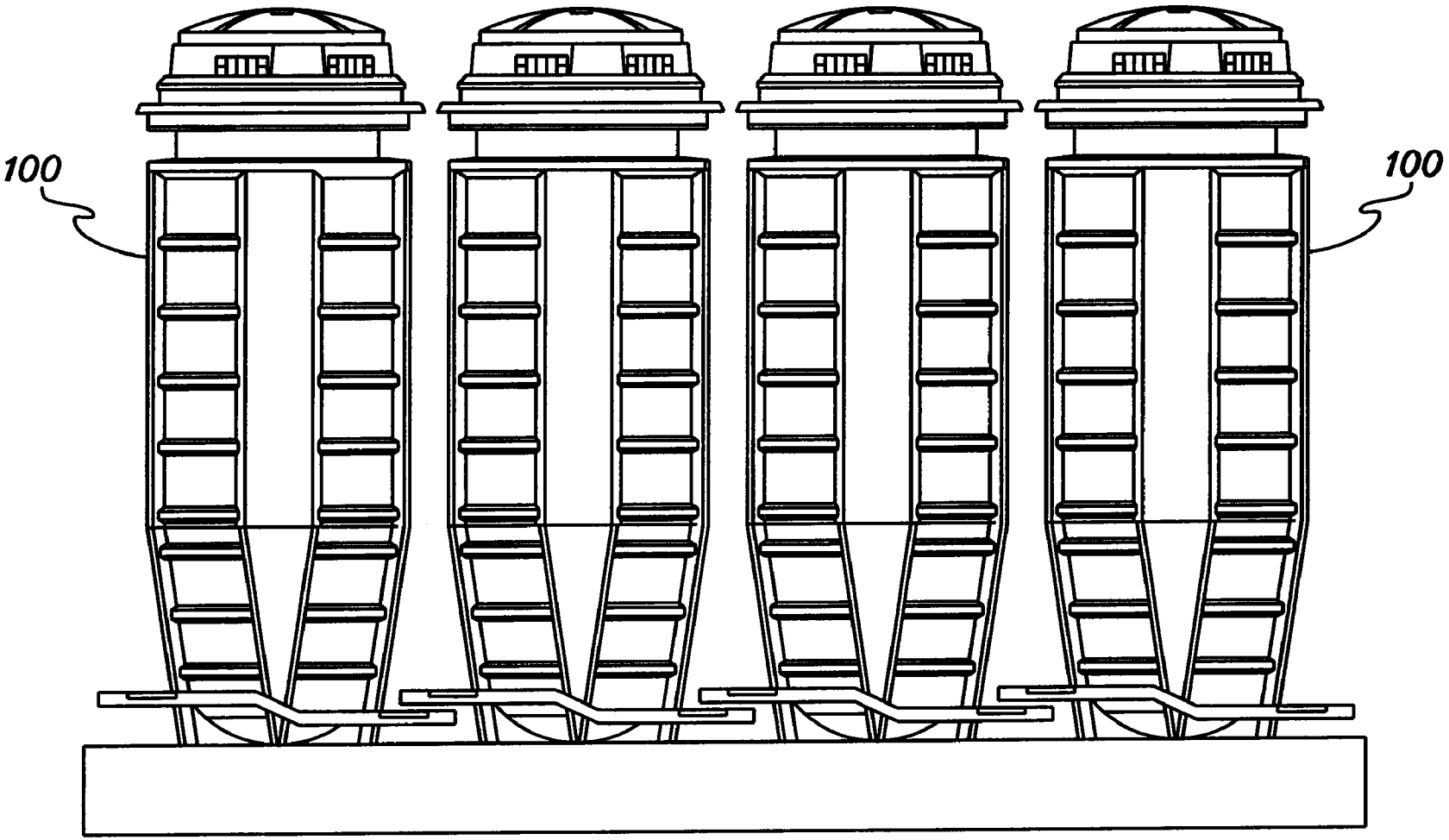
FIG. 5 is a side elevational view of a plurality of grinder pump systems of FIG. 3 nested together for shipping.

FIGS. 3 and 4 illustrate another embodiment of a sewage tank 100 in accordance with the present invention (generally similar to sewage tank 20) which includes an integrally formed stepped ballast ring 110 that extends around the bottom of the sewage tank and which is sized to eliminate the need for installing a concrete ballast. In addition, the stepped configuration allows a plurality of sewage tanks to be nested together for shipment as best shown in FIG. 5. For example, on one side of the sewage tank, a portion of the flange is disposed at a different vertical height than an opposite portion of the flange. The lower and higher portions of the flange allow a plurality of sewage tanks to be compactly arranged as shown in FIG. 5 to optimize shipping.

Another feature is that the top may incorporate two flats 112 on the side of the tank so that a forklift truck can readily grab the tank and so that the need to bolt the tank to a traditional pallet is eliminated. The forklift truck may engage the top of the tank by either of two directions and reduce the effort required in loading and unloading the tank.

In addition, upwardly-extending protrusions or stops 120 (FIG. 3) may be molded into the inner bottom surface for receiving and retaining the stand for supporting the grinder pump in the center of the tank. For example, four protrusions may be provided.

Figure 6:
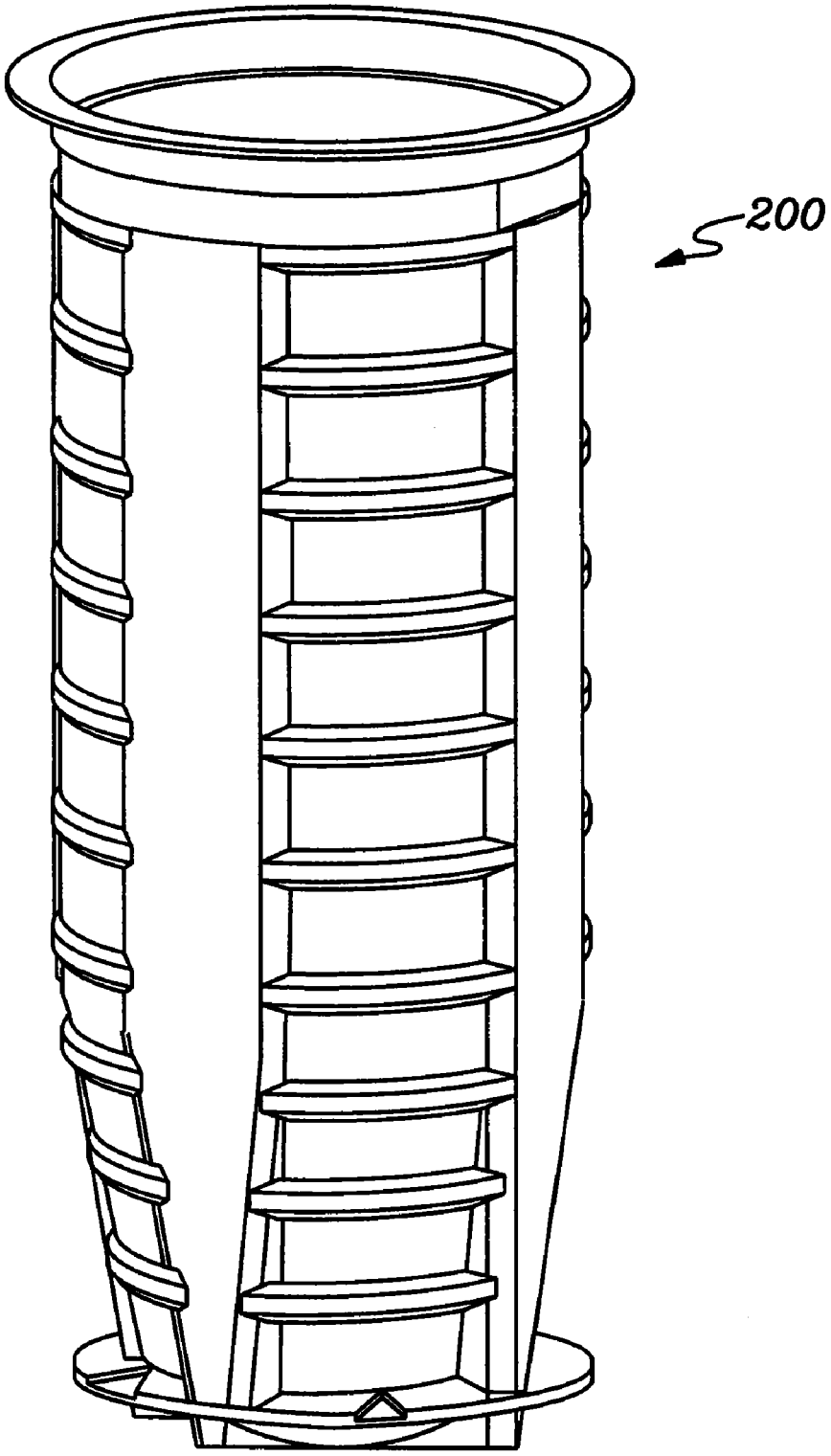
FIG. 6 is a perspective view of another embodiment of a grinder pump system in accordance with the present invention.
Figure 7:
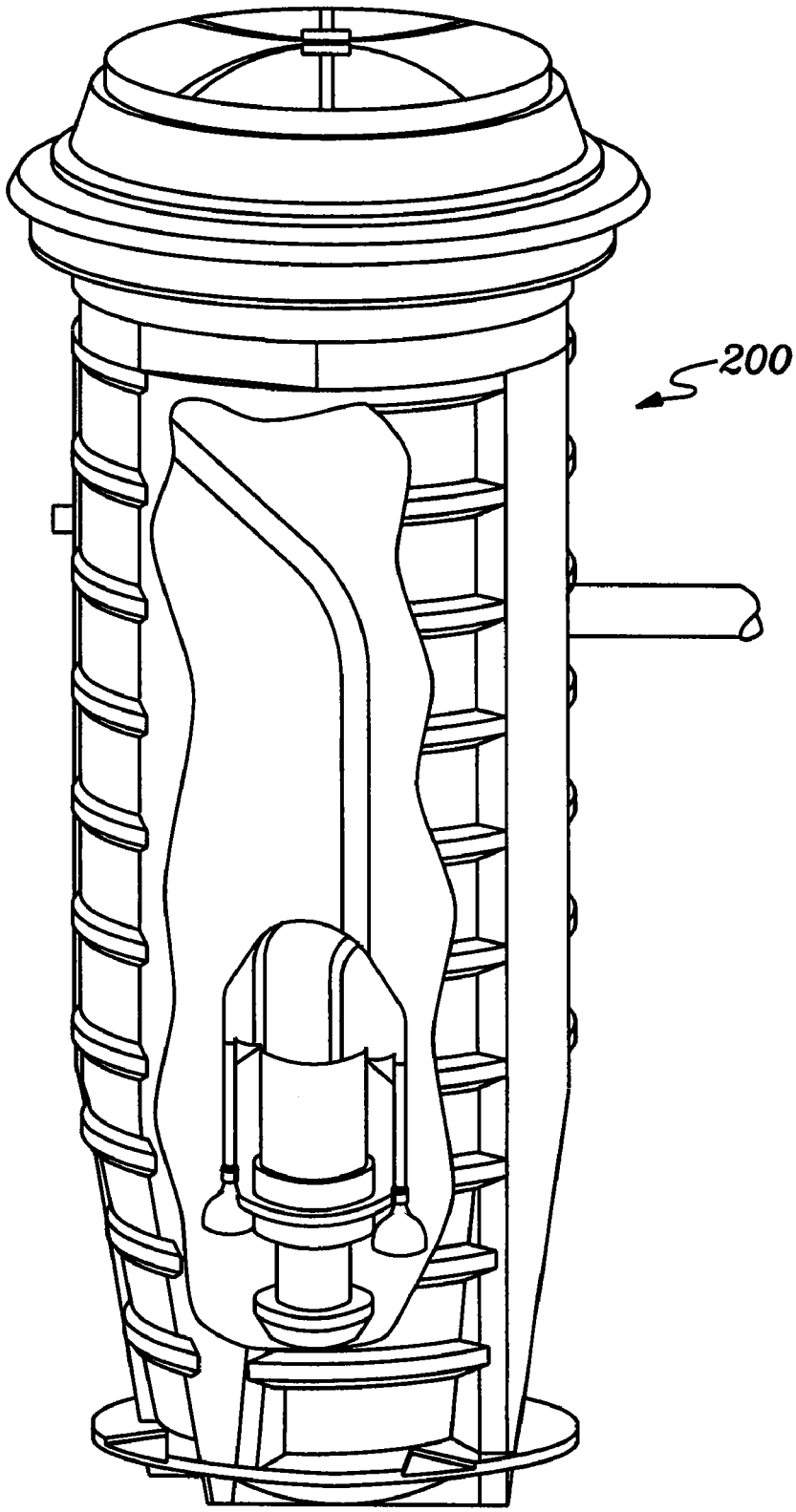
FIG. 7 is a perspective view, partially cutaway, of the grinder pump system of FIG. 6.
Figure 8:
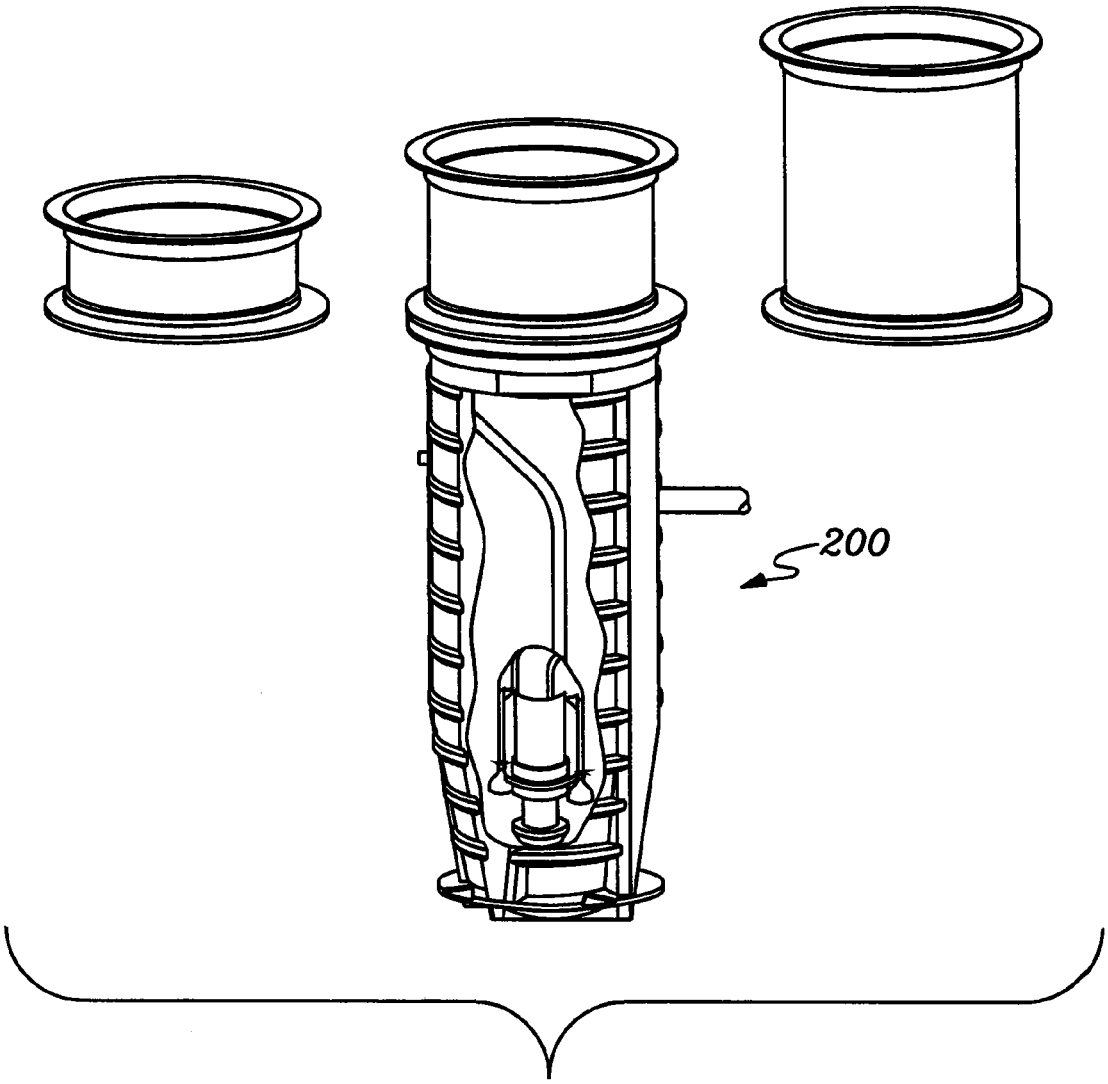
FIG. 8 is a front elevational view, partially cut away, of the grinder pump system of FIG. 7 along with a plurality of access ways.

FIGS. 6-8 illustrate another embodiment for a sewage tank 200 in accordance with the present invention which is generally similar to sewage tank 20 and which includes the sewage tank having a relatively large diameter flange formed integral with the tank. The flange is desirably sized large enough to provide suitable ballast to keep the sewage tank from floating without the need for concrete. It is also noted that the flange may be employed to anchor the sewage tank in a concrete ballast.

The various tanks may incorporate a series of four vertical ribs. The vertical areas are designed so that an opening may be cut along the vertical area for receiving a feed wastewater pipe. A grommet may be placed in the opening for receiving and sealing around the inlet pipe. Similarly, an opening may be cut along a vertical area through which a discharge pipe may pass. In addition, an opening may be cut along the vertical area through which a vent may pass. The feed wastewater pipe, discharge pipe, and vent may also pass through the horizontal ribs or pockets between the ribs.

The top may also be set up to receive an access way extension (e.g., as shown in FIG. 8) so that the height of the sewage tank could be increased in various increments. In addition, the sewage tank may include a releasably sealable cap having a vent opening as shown in FIG. 7.

Figure 9:
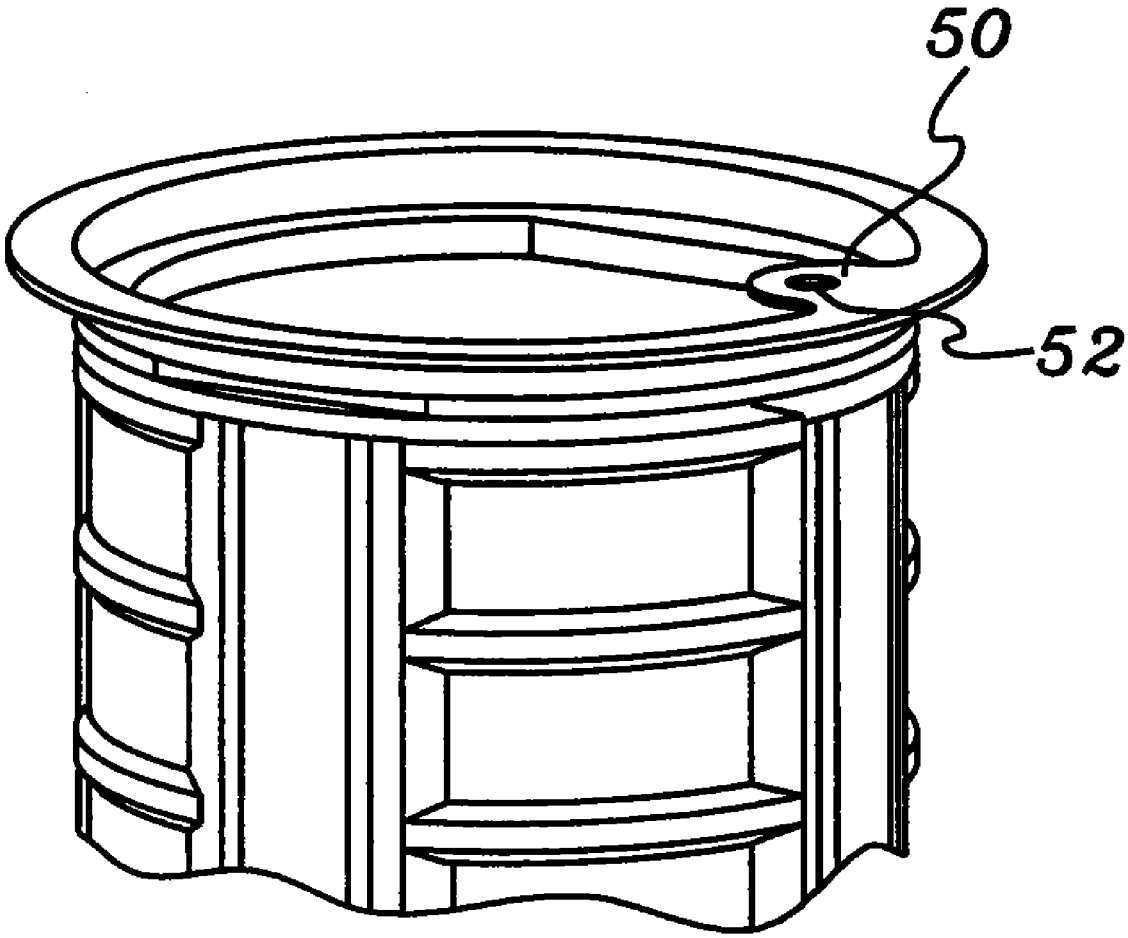
FIG. 9 is a perspective view of one embodiment of a top of a sewage tank having an inwardly-extending member for providing a vent in accordance with the present invention.

During fabrication of the tank, a top may be integrally formed with the sidewall and bottom. The top can then be cut out, e.g., trimmed to provide an opening to the tank, during installation. Desirably, the top or cover may be either isolated or contain a vent tab allowing either internally venting through a cover system or laterally through the sidewall. FIG. 9 illustrates a top having inwardly-extending portion 50 forming a kidney-shaped cutout in the top. The inwardly-extending portion may include a vent opening 52.

Figure 10:
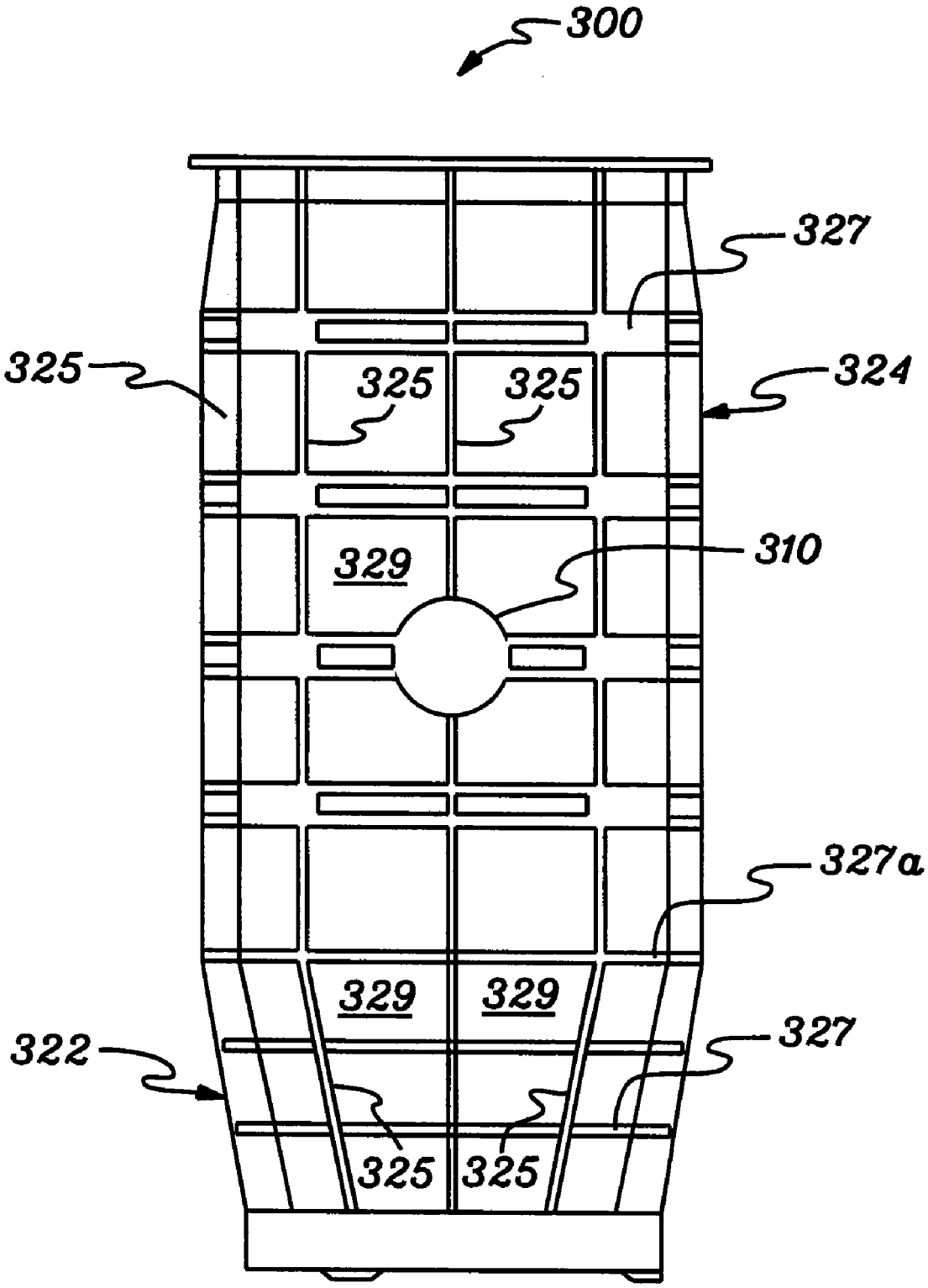
FIG. 10 is a front elevational view of another embodiment of a grinder pump system in accordance with the present invention.
Figure 11:
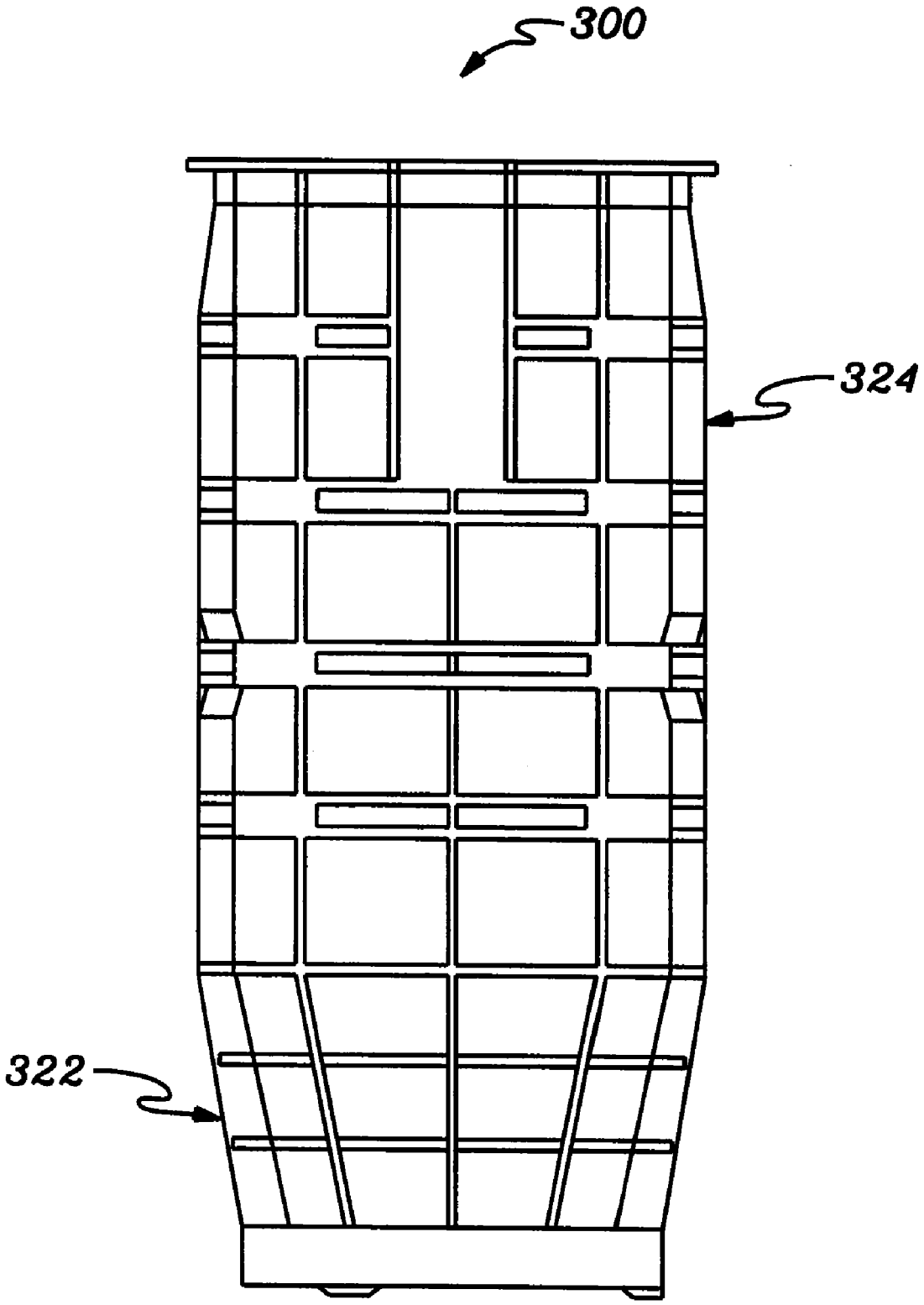
FIG. 11 is a left side elevational view of the grinder pump system of FIG. 10.
Figure 12:
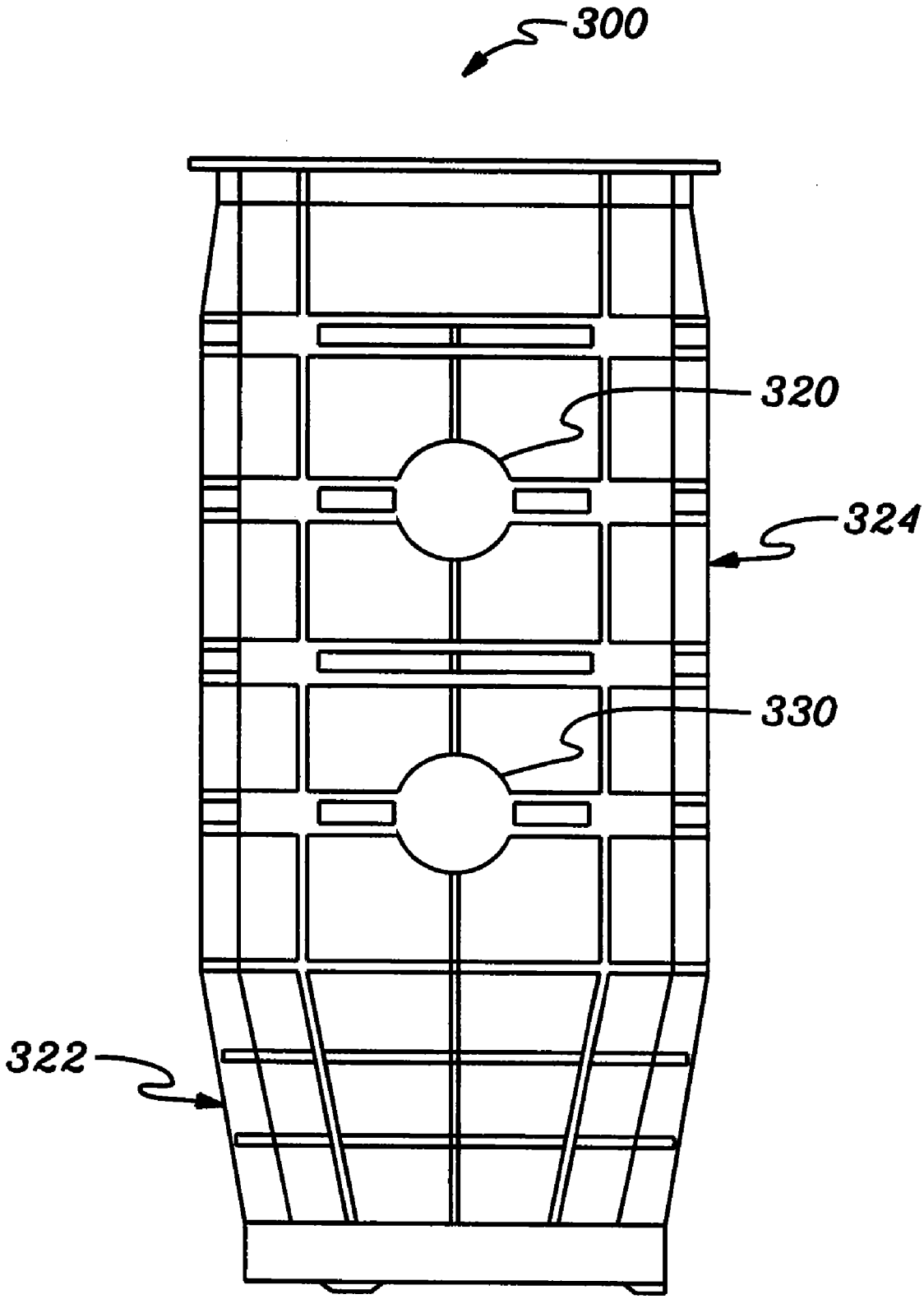
FIG. 12 is a right side elevational view of the grinder pump system of FIG. 10.

FIGS. 10-12 illustrate another embodiment for a sewage tank 300 in accordance with the present invention which is generally similar to sewage tank 20. Sewage tank 300 includes a container having a lower portion 322 and an upper portion 324 which together define a chamber. In one aspect, the upper portion has a generally constant cross-section, e.g., generally cylindrical, and the lower portion has a tapering cross-section to reduce the volume of retained sewage. The upper portion and the lower portion may include a plurality of intersecting vertical ribs 325 and horizontal ribs 327 defining a plurality of recessed pockets 329. Horizontal rib 327*a* straddles both the upper portion and the lower portion. A plurality of raised pads 310, 320, and 330 may be provided for use in providing an opening for an inlet for a feed wastewater pipe or discharge pipe. The location of the pads may be staggered along the length of the upper portions of the tank. The pads, ribs, and pockets allow providing an opening for installation of at least one of a feed wastewater pipe and a discharge pipe at continuous selectable elevations along the upper portion of the sewage tank. In addition, some of the plurality of vertical and horizontal ribs may be solid ribs.

Figure 13:
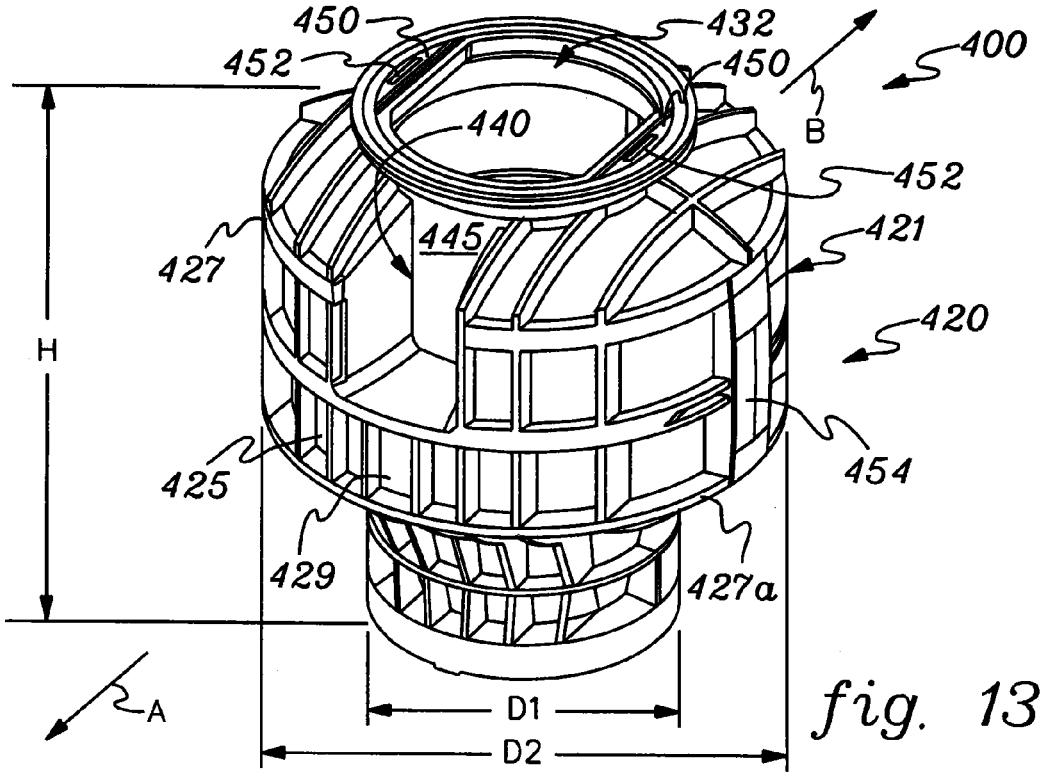
FIG. 13 is a perspective view of another embodiment of a sewage tank in the form of a squat tank in accordance with the present invention.
Figure 14:
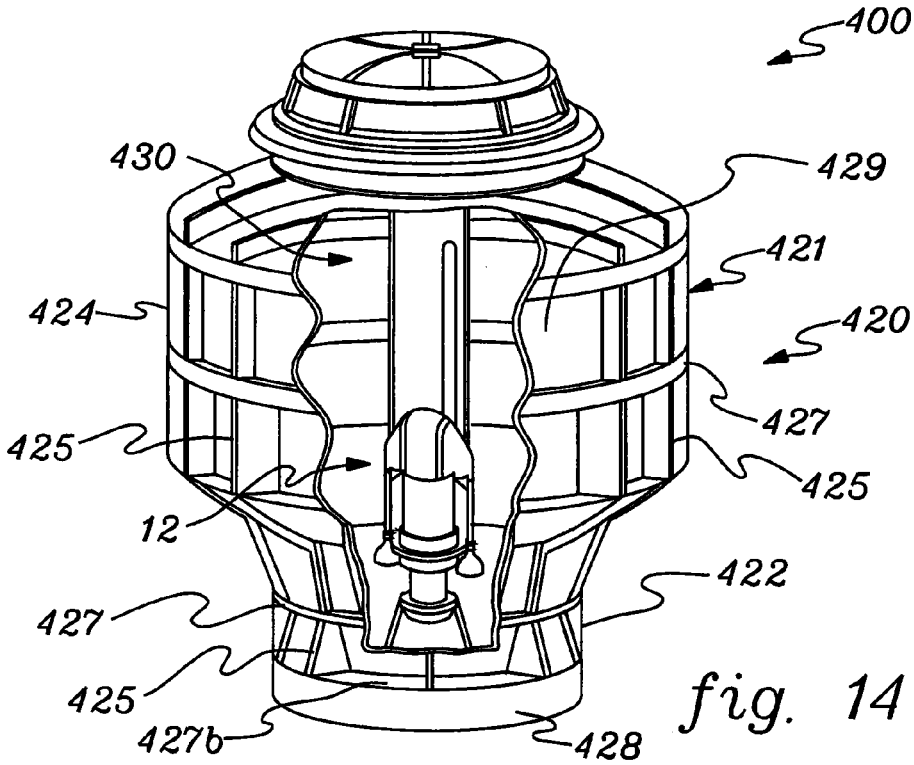
FIG. 14 is a front elevational view, partially cutaway, of the sewage tank of FIG. 13 illustrating a grinder pump contained therein.

FIGS. 13 and 14 illustrate another embodiment of a low-pressure grinder pump wastewater disposal system 400 in accordance with the present invention for collecting, grinding, and pumping wastewater. System 400 generally includes a sewage tank 420, generally in the form of a bulbous or squat tank configuration, and a grinder pump 12 (FIG. 4).

System 400 is readily installable in the ground by connecting the system to a wastewater feed pipe, a wastewater discharge pipe, and an electrical power supply. The system may also be connected to or include a vent. The exemplary wastewater disposal system provides a convenient, self-contained unit. In addition, the exemplary system is readily accessible and serviceable by a technician or a repairperson.

Sewage tank 420, generally in the form of a squat tank, includes a container 421 having a lower tapering portion 422 and an upper portion 424 which together define a chamber 430 therein for receiving wastewater, for example, from a building. In this illustrated embodiment, upper portion 424 generally has a diameter D2, and lower portion 422 generally has a diameter D1 so that diameter D2 is greater than diameter D1. A height H of the tank may be about equal to diameter D2. The height of the tank and the diameter of the upper portion may be between about 50 inches to about 55 inches. The diameter of the lower portion may be about 30 inches.

In addition, upper portion 424 and lower portion 422 may include a plurality of vertical ribs 425 and intersecting horizontal ribs 427 defining a plurality of recessed pockets 429. A horizontal rib 427*a* straddles the upper and lower portions. A horizontal rib 427*b* may include an apron 428. The ribs may be hollow or solid. In addition, upper portion 424 may include a recessed portion 440 having a vertical wall 445 configured to provide an opening for installation of at least one of an outlet and/or a vent. The vertical wall 445 is easily accessed from the top of the sewage tank. An elongated rib or pad 454 allows a variable location for providing an opening for an inlet. The upper portion of the tank may have a tapering portion which defines an access opening 432. The upper portion (as well as the lower tapering portion) may be curved for added strength. Piping through the vertical wall 445 disposed adjacent to the access opening can be readily accessed by a workman through the access opening. Additional recessed portions may also be provided. The bottom of the sewage tank may include a concave bottom.

The top of sewage tank 420 may be integrally formed with the sidewall and bottom. The top can then be cut out, e.g., trimmed to provide an opening to the tank, during installation. Desirably, the top or cover may be either isolated or contain one or more vent tabs allowing either internally venting through a cover system or laterally through the sidewall. As shown in FIG. 13, the top includes inwardly-extending portions 450, each having a vent opening 452.

The grinder pump for use in the various systems may include a grinder mechanism for pulverizing solids or semisolid matter in the wastewater, a pump assembly attached to the grinder mechanism for pumping ground wastewater through the grinder pump, and a motor. For example, a grinder mechanism may include a stationary outer ring and a rotating cutting blade, and a pump assembly may include a progressing cavity pump having a pump housing, a pump stator, and a pump rotor. It will be appreciated by those skill in the art that other suitable grinder pumps, grinding mechanisms and pump assemblies may be employed.

A motor housing casting houses the electric motor for powering both the grinder mechanism and the pump assembly. As noted above, the housing is preferably attached to a support that sits on the bottom of the sewage tank.

As noted above, the grinder pump is connected to wastewater discharge pipe. In operation, wastewater is drawn into grinder mechanism for cutting or grinding of the solids or semisolid matter in the wastewater. The resulting processed particulate effluent passes through pump assembly and then through the wastewater discharge pipe. The processed wastewater may travel to a remote location, e.g., to a pressure sewage main and ultimately to a sewage treatment plant.

The grinder pump may include one or more sensing tubes to sense pressure variations for measuring the level of wastewater collected in tank. A processor and/or a mechanical-electrical relay are desirably operable, upon the wastewater reaching a predetermined wastewater level, to energize the motor within the motor housing casting.

The various sewage tanks may be rotational molded and formed from high-density polyethylene. A mold may be set up so that a sewage tank may be formed for use with a detachable flange or with a relatively small integral flange for use with concrete or a relatively larger flange so that concrete is not required.

In addition, the plurality of vertical ribs and the plurality of horizontal ribs on one side of the container may be aligned in one direction, and the plurality of vertical ribs and the plurality of horizontal ribs on the other side of the container may be aligned in the opposite direction. Such a configuration of ribs is best illustrated in FIG. 13, with the ribs on the front aligned in a first direction shown by arrow A and the ribs on the rear aligned in an opposite direction shown by arrow B.

This configuration of ribs allows the forming of the tank using a two-piece mold, e.g., a front half mold and a rear half mold, for forming the sides. A top mold may be used for forming the top of the sewage tank and a bottom mold may be used for forming the bottom of the tank. The two molds for the sides may have cutouts (the reverse of the ribs shown in FIGS. 9, 13 and 14) for forming the plurality of intersecting vertical ribs and horizontal ribs. In particular, the cutouts in one of the side molds may be aligned in one direction and the cutouts in the other of the side molds may be aligned in the opposite direction. The cutouts being aligned in the direction of draw allows for pulling the mold halves apart after forming the tank therein. It is noted that where the two mold halves meet, a vertical rib may be formed therebetween.

While some of the sewage tanks of the present invention are illustrated as having a constant tapering lower portion, it is appreciated that the tapered portions may be curved or have other reduced-size configurations compared to the upper portion.

For the embodiments of the sewage tank where the flange is not needed or where concrete is required, installation may include digging a hole, placing the sewage tank in the ground, and then pouring concrete down in the bottom of the hole.

While various embodiments of the present invention have been illustrated and described, it will be appreciated by those skilled in the art that many further changes and modifications may be made thereunto without departing from the spirit and scope of the invention.

The invention claimed is:

1. A sewage tank for use with a pump to convey sewage, said sewage tank comprising:

a container having an upper portion and a lower tapering portion defining a chamber, and having a longitudinal axis, said lower tapering portion comprising a lowermost portion defining a bottom of said container, and said lower tapering portion having a reduced size compared to said upper portion;

an outwardly-extending member comprising a plurality of separate outwardly-extending member portions releasably attachable around said lower tapering portion of said container and disposable generally normal to said longitudinal axis, said plurality of separate outwardly-extending member portions being attachable below a bottom of the upper portion, and being attachable generally adjacent to said bottom of said container so that an elevational distance from said plurality of separate outwardly-extending member portions to said bottom of said upper portion is greater than an elevational distance from said plurality of separate outwardly-extending member portions to said bottom of said container; and said lower tapering portion of said container and said outwardly-extending member being configured to allow backfilling of material in an area between an upper surface of said outwardly-extending member and an outside surface of said lower tapering portion of said sewage tank so that the backfill provides sufficient ballast under high ground water conditions.

2. The sewage tank of claim 1 wherein said lower tapering portion comprises an angle of about 10 degrees from vertical, and the outwardly-extending member extends beyond said upper portion.

3. The sewage tank of claim 2 wherein a radial distance of said outwardly-extending member under the upper portion is about equal to a radial distance of said outwardly-extending member that extends beyond said upper portion.

4. The sewage tank of claim 1 wherein said outwardly-extending member comprises an outwardly-extending flange.

5. The sewage tank of claim 1 wherein said upper portion comprises an inwardly-extending portion for providing an opening for a vent.

6. The sewage tank of claim 5 wherein said upper portion is integrally formed with said inwardly-extending portion to provide said opening for the vent.

7. A pump system comprising:

a sewage tank of claim 1; and a pump disposable in said sewage tank.

8. The pump system of claim 7 wherein said pump comprises a grinder pump.

9. A sewage tank for use with a pump to convey sewage, said sewage tank comprising:

a container for containing the pump; and said container comprising an upper portion defining a horizontally disposed access opening accessible therethrough by a workman to said container and defining an integrally formed generally horizontal inwardly-extending portion extending into said access opening adjacent to a side of said container so that said access opening comprises a kidney-shaped access opening, said horizontal inwardly-extending portion having a horizontally-extending opening disposed adjacent to said side of said container for a vent.

10. A pump system comprising:

a sewage tank of claim 9; and a pump disposable in said sewage tank.

11. The pump system of claim 10 wherein said pump comprises a grinder pump.

12. A method of installing a sewage tank, the method comprising:

providing a sewage tank of claim 1 having a lower tapering portion and an outwardly-extending member; and backfilling around the lower tapering portion of the sewage tank.

13. A sewage tank for use with a pump to convey sewage, said sewage tank comprising:

a container for containing the pump;

a lower portion of said container comprises an outwardly-extending member configured to allow backfilling of said sewage tank so that the backfill provides sufficient ballast under high ground water conditions;

wherein said outwardly-extending member comprises a first portion disposed at a first vertical elevation, and a second portion disposed at a second vertical elevation different from said first vertical elevation so that when upright first and second sewage tanks are nested together with upper and lower portions disposed side-by-side for shipment, said first portion of said outwardly-extending member of said first sewage tank is positionable over said second portion of said outwardly-extending member of said second sewage tank.

14. The sewage tank of claim 13 wherein said outwardly-extending member comprises a third portion and a fourth portion disposed on an angle and between said first portion and said second portion.

15. The sewage tank of claim 13 wherein said outwardly-extending member comprises an outwardly-extending flange.

16. The sewage tank of claim 13 wherein said outwardly-extending member and said lower portion of said container is monolithic.

17. The sewage tank of claim 13 wherein said lower portion comprises a lower tapering portion having a reduced size compared to an upper portion of said container.

18. The sewage tank of claim 13 wherein said first upper surface of said outwardly-extending member is operably connected to said second upper surface of said outwardly-extending member.

19. The sewage tank of claim 1 wherein said container comprises a plurality of intersecting ribs.

20. The sewage tank of claim 1 wherein said container is monolithic.

21. The sewage tank of claim 1 wherein said upper portion comprises an inwardly disposed recessed portion having a vertically disposed planar wall.

22. The sewage tank of claim 9 wherein said container comprises a plurality of intersecting ribs.

23. The sewage tank of claim 9 wherein said container is monolithic.

24. The sewage tank of claim 9 wherein said upper portion comprises an inwardly disposed recessed portion having a vertically disposed planar wall.

25. The sewage tank of claim 13 wherein said container comprises a plurality of intersecting ribs.

26. The sewage tank of claim 13 wherein said upper portion comprises an inwardly disposed recessed portion having a vertically disposed planar wall.

27. The sewage tank of claim 1 wherein said plurality of separate outwardly-extending member portions comprise a plurality of generally arcuate-shaped members.

28. The sewage tank of claim 27 wherein said plurality of generally arcuate-shaped members comprises a pair of generally arcuate-shaped members.

29. The sewage tank of claim 27 wherein said plurality of generally arcuate-shaped members and said outer surface of said container comprise interlocking portions.

30. The sewage tank of claim 27 wherein said plurality of generally arcuate-shaped members and said outer surface of said container comprise an interlocking tongue and groove.

* * * * *